US010282933B2

(12) United States Patent
Nallaperumal et al.

(10) Patent No.: US 10,282,933 B2
(45) Date of Patent: May 7, 2019

(54) MEDIA STORAGE DEVICE

(71) Applicant: HCL Technologies Limited, Uttar Pradesh (IN)

(72) Inventors: Buvanesh Nallaperumal, Chennai (IN); Thiruvalan Venkatesan, Tamil Nadu (IN); Prakash Mahadevan Srinivasan, Tamil Nadu (IN); Mayilvaganan Thangavel, Tamil Nadu (IN); Mukundh Balakrishnan, Tamil Nadu (IN); Sindhu Selvaraj, Karnataka (IN)

(73) Assignee: HCL Technologies Limited, Noida, Uttar Pradesh ( * ) Notice: Subject to any disclaimer, the term of this patent is extended or adjusted under 35 U.S.C. 154(b) by 299 days.

(21) Appl. No.: 15/268,090

(22) Filed: Sep. 16, 2016

(65) Prior Publication Data

US 2018/0025569 A1 Jan. 25, 2018

(30) Foreign Application Priority Data

Jul. 21, 2016 (IN) ..... 201611025020

(51) Int. Cl.
*G07D 11/00* (2019.01)

(52) U.S. Cl.
CPC ..... *G07D 11/0012* (2013.01); *G07D 11/0006* (2013.01)

(58) Field of Classification Search
CPC ..... G07D 11/0012; G07D 11/0009; G07D 11/0006; G07D 11/0003; B65G 47/5181
See application file for complete search history.

(56) References Cited

U.S. PATENT DOCUMENTS 495,241 A * 4/1893 Braun ..... G07F 5/02 194/256
3,601,396 A * 8/1971 Rovin ..... A41H 43/0207 271/194
3,710,976 A 1/1973 Guidi et al.
3,773,223 A * 11/1973 Guidi ..... G07D 11/0006 221/67
3,946,879 A * 3/1976 Jensen ..... B65H 33/08 414/791.2
4,015,842 A * 4/1977 Perry ..... B65H 33/08 271/185

(Continued)

*Primary Examiner* — Christopher Stanford
(74) *Attorney, Agent, or Firm* — HM Law Group LLP; Vani Moodley, Esq.

(57) ABSTRACT

Disclosed is an apparatus for storing media. The apparatus comprises a bottom cover, a pillar assembly mounted inside the bottom cover, a handling plate mounted within the pillar assembly and coupled to the pillar assembly via a linear actuator assembly. Further, the bottom cover comprises a cassette indexing mechanism mounted on the bottom surface of the bottom cover and a media entry assembly mounted through the side wall of the bottom cover. Furthermore, the pillar assembly comprises a shaft extending through the bottom surface of the bottom cover and the shaft is coupled with the cassette indexing mechanism for indexing the pillar assembly in a predefined configuration. Further, the handling plate is indexed along with the pillar assembly during operation, and the handling plate is configured to store a plurality of media indexed with respect to each other.

8 Claims, 11 Drawing Sheets

(56) References Cited

U.S. PATENT DOCUMENTS

| | | | | | |
|---|---|---|---|---|---|
| 4,350,264 | A * | 9/1982 | Muller | G07F 11/045 | 221/197 |
| 4,354,787 | A * | 10/1982 | Gensike | B65G 59/065 | 271/213 |
| 4,625,893 | A * | 12/1986 | Reiter | G07F 11/04 | 221/279 |
| 4,890,825 | A * | 1/1990 | McCormick | B65H 31/38 | 271/188 |
| 5,415,519 | A * | 5/1995 | Lee | B65G 57/302 | 414/791.2 |
| 5,695,314 | A * | 12/1997 | Hohmann | B65G 59/065 | 271/104 |
| 6,015,147 | A * | 1/2000 | Kimura | G07D 11/0003 | 209/534 |
| 6,293,424 | B1 | 9/2001 | Love | | |
| 6,361,043 | B1 | 3/2002 | Hutchison | | |
| 2003/0155701 | A1* | 8/2003 | Bakodledis | B65G 47/5181 | 271/9.05 |

* cited by examiner

Isometric View

Right View

Front View

Top View

Top View

Front View

Right View

MEDIA STORAGE DEVICE

CROSS-REFERENCE TO RELATED APPLICATIONS AND PRIORITY

The present application claims benefit from Indian Complete Patent Application No. 201611025020, filed on Jul. 21, 2016, the entirety of which is hereby incorporated by reference.

TECHNICAL FIELD

The present subject matter described herein, in general, relates to an apparatus for storing, and more particularly an apparatus for storing media.

BACKGROUND

Self-service terminals such as Automated Teller Machines (ATMs) have become a common feature in today's world. Generally these self-service terminals are configured to accept deposits and/or dispense from a terminal. For example, Automated Teller Machines (ATMs) typically utilize conventional recycling modules to enable media, such as bank notes, newspapers, to be dispensed when desired from a conventional storage cassette mounted within the ATM, also to receive a media from a user and store it back into the conventional storage cassette.

Typically, the conventional currency recyclers/ATMs store the media either as stacks inside the conventional storage cassette or as separate rolled sheets wrapped with tape(s) around a number of rollers/drums. The media, stored in the roll form within the conventional cassette storage, may retain part of the curved shape developed due to being wrapped on a cylindrical drum. This effect can be worsened if the stored media was already badly curved prior to being stored. Such curved/crumpled media causes a strain on design of the media path for receiving or delivering a media. Further, the traditional media handling devices fail when handling the curved media; as such curled media have a tendency to increase a risk of jams occurring within the transport path. Furthermore, the tapes present in the conventional systems are prone to wear & tear, and the only option in case of wear & tear is to replace the system. Moreover, the arrangements of the multiple rolls in the conventional system are complex in nature and are not easily serviceable. Furthermore, the conventional cassette storage for both stacked and rolled format requires expensive and intricate mechanism to separate the multiple media as the media tend to stick to each other. Additionally, the conventional cassette storage for both stacked or rolled format include skew and is prone to multi-feeding/miss-feeding issues. Thus there exists a need for a media storage apparatus.

SUMMARY

Before the present apparatus for storing media, are described, it is to be understood that this application is not limited to the particular apparatus, and methodologies described, as there can be multiple possible embodiments which are not expressly illustrated in the present disclosures. It is also to be understood that the terminology used in the description is for the purpose of describing the particular implementations or versions or embodiments only, and is not intended to limit the scope of the present application. This summary is provided to introduce aspects related to apparatus for storing media. This summary is not intended to identify essential features of the claimed subject matter nor is it intended for use in determining or limiting the scope of the claimed subject matter.

In one implementation, an apparatus for storing media may be disclosed. In one aspect, the apparatus may comprise a bottom cover, a pillar assembly mounted inside the bottom cover and a handling plate mounted within the pillar assembly and coupled to the pillar assembly via a linear actuator assembly. Further, the bottom cover comprises a cassette indexing mechanism mounted on the bottom surface of the bottom cover and a media entry assembly mounted through the side wall of the bottom cover. The pillar assembly may comprise a shaft that may extend through the bottom surface of the bottom cover upon assembly. The shaft may be further coupled with the cassette indexing mechanism for indexing the pillar assembly in a predefined configuration. Furthermore, the handling plate may be indexed along with the pillar assembly during operation in a predefined configuration. In one example, indexing may be understood as rotating of the pillar assembly along with the holding plate in a predefined step such as 30 degrees in one of a clockwise or an anti-clockwise around a central axis of the apparatus. The linear actuator assembly may be further configured to move the handling plate in one of an upward direction and a downward direction during operation based on the number of media received or delivered. Further, the handling plate may be configured to store a plurality of media stacked on one top of other and in indexed at a predefined angle with respect to each other, such as 45 degrees.

In one implementation, one other apparatus for receiving and storing media is disclosed. In one aspect, the apparatus may comprise a bottom cover. The bottom cover may comprises a cassette indexing mechanism mounted on the bottom surface of the bottom cover and a media entry assembly mounted through the side wall of the bottom cover. Further during operation the media entry assembly may be configured to receive a media. The apparatus may further comprise a pillar assembly mounted inside the bottom cover. The pillar assembly may comprise a shaft extending through the bottom surface of the bottom cover. The shaft may be coupled with the cassette indexing mechanism for indexing the pillar assembly in a predefined configuration during operation; the apparatus may furthermore comprise a handling plate mounted within the pillar assembly and coupled to the pillar assembly via a linear actuator assembly. Further, during operation the handling plate may be configured to store the media received on the surface of the handling plate and indexed to a previous media based on the indexing of the pillar assembly. Furthermore during operation the linear actuator assembly may be configured to move the handling plate during operation in a downward direction based on the number of media received.

In one implementation, one more apparatus for delivering a stored media is disclosed. In one aspect, the apparatus may comprise a bottom cover. The bottom cover may comprise a cassette indexing mechanism mounted on the bottom surface of the bottom cover and a media entry assembly mounted through the side wall of the bottom cover. Further during operation the media entry assembly may be configured to deliver a media from plurality of media. The apparatus may further comprise a pillar assembly mounted inside the bottom cover. The pillar assembly may comprise a shaft extending through the bottom surface of the bottom cover. Further, the shaft may be coupled with the cassette indexing mechanism for indexing the pillar assembly in a predefined configuration during operation. The apparatus may furthermore comprise a handling plate mounted within the pillar assembly and coupled to the pillar assembly via a linear actuator assembly. Further, during operation the handling plate may be configured to store the plurality of media on surface indexed to each other and the linear actuator assembly may be further configured to move the handling plate during operation in an upward direction and downward direction based on a number of media delivered. The apparatus may furthermore comprise a media pick up assembly mounted on the side wall of the bottom cover, wherein during operation the media pickup assembly may be configured to pick a media from the plurality of media for delivering.

BRIEF DESCRIPTION OF THE DRAWINGS

The foregoing detailed description of embodiments is better understood when read in conjunction with the appended drawings. For the purpose of illustrating of the present subject matter, an example of construction of the present subject matter is provided as figures; however, the invention is not limited to the specific apparatus disclosed in the document and the figures.

The present subject matter is described detail with reference to the accompanying figures. In the figures, the left-most digit(s) of a reference number identifies the figure in which the reference number first appears. The same numbers are used throughout the drawings to refer various features of the present subject matter.

DETAILED DESCRIPTION

Figure 1:
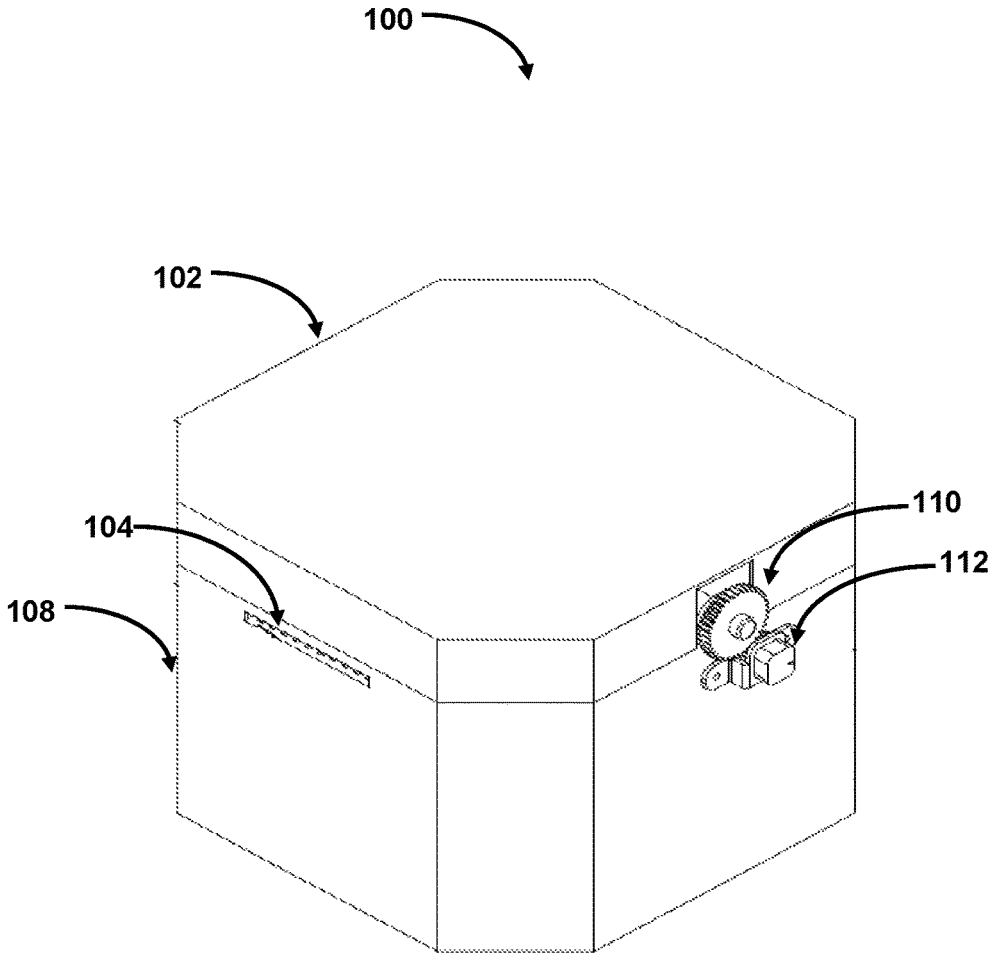
FIG. 1 illustrates isometric view of an apparatus for storing media, in accordance with an embodiment of the present subject matter.

Some embodiments of this disclosure, illustrating all its features, will now be discussed in detail. The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items. It must also be noted that as used herein and in the appended claims, the singular forms "a," "an," and "the" include plural references unless the context clearly dictates otherwise. Although any apparatus for storing media, similar or equivalent to those described herein can be used in the practice or testing of embodiments of the present disclosure, the exemplary, apparatus for storing media are now described. The disclosed embodiments for storing media are merely examples of the disclosure, which may be embodied in various forms.

Various modifications to the embodiment will be readily apparent to those skilled in the art and the generic principles herein may be applied to other embodiments for storing media. However, one of ordinary skill in the art will readily recognize that the present disclosure for storing media is not intended to be limited to the embodiments described, but is to be accorded the widest scope consistent with the principles and features described herein.

In one implementation, an apparatus for storing media may be disclosed. In one aspect, the apparatus may comprise a bottom cover, a pillar assembly mounted inside the bottom cover and a handling plate mounted within the pillar assembly and couple to the pillar assembly via a linear actuator assembly. Further, the bottom cover comprises a cassette indexing mechanism mounted on the bottom surface of the bottom cover and a media entry assembly mounted through the side wall of the bottom cover and the pillar assembly comprises a shaft extending through the bottom surface of the bottom cover. The shaft may be coupled with the cassette indexing mechanism for indexing the pillar assembly in a predefined configuration. In one example, predefined configuration may be moving one of an anti-clock wise direction for a predefined number of steps and moving in a clockwise direction for a predefined number of steps in an alternating manner. For example, moving for 3 steps in an anti-clockwise manner and then moving in a clock wise manner for 3 three steps, such that the exits side of the handling plate is in line with the media pick-up assembly. The handling plate may be indexed along with the pillar assembly during operation. Further, the handling plate and the pillar assembly may be indexed as a single assembly. Indexing may be understood in one example, as rotation of the pillar assembly along with the holding plate in a predefined configuration around the central axis of the apparatus. In one other example, the rotation may be in form of steps of predefined angle in one of a clockwise and anti-clockwise direction. The linear actuator assembly may be configured to move the handling plate in one of an upward direction and a downward direction. The handling plate may be configured to store a plurality of media indexed with respect to each other. The apparatus may further comprise a media pick up assembly mounted on the side wall of the bottom cover for picking up a media from a plurality of media stored in the apparatus during operation and a top cover mounted over the bottom cover for covering the internal assembly.

Figure 2:
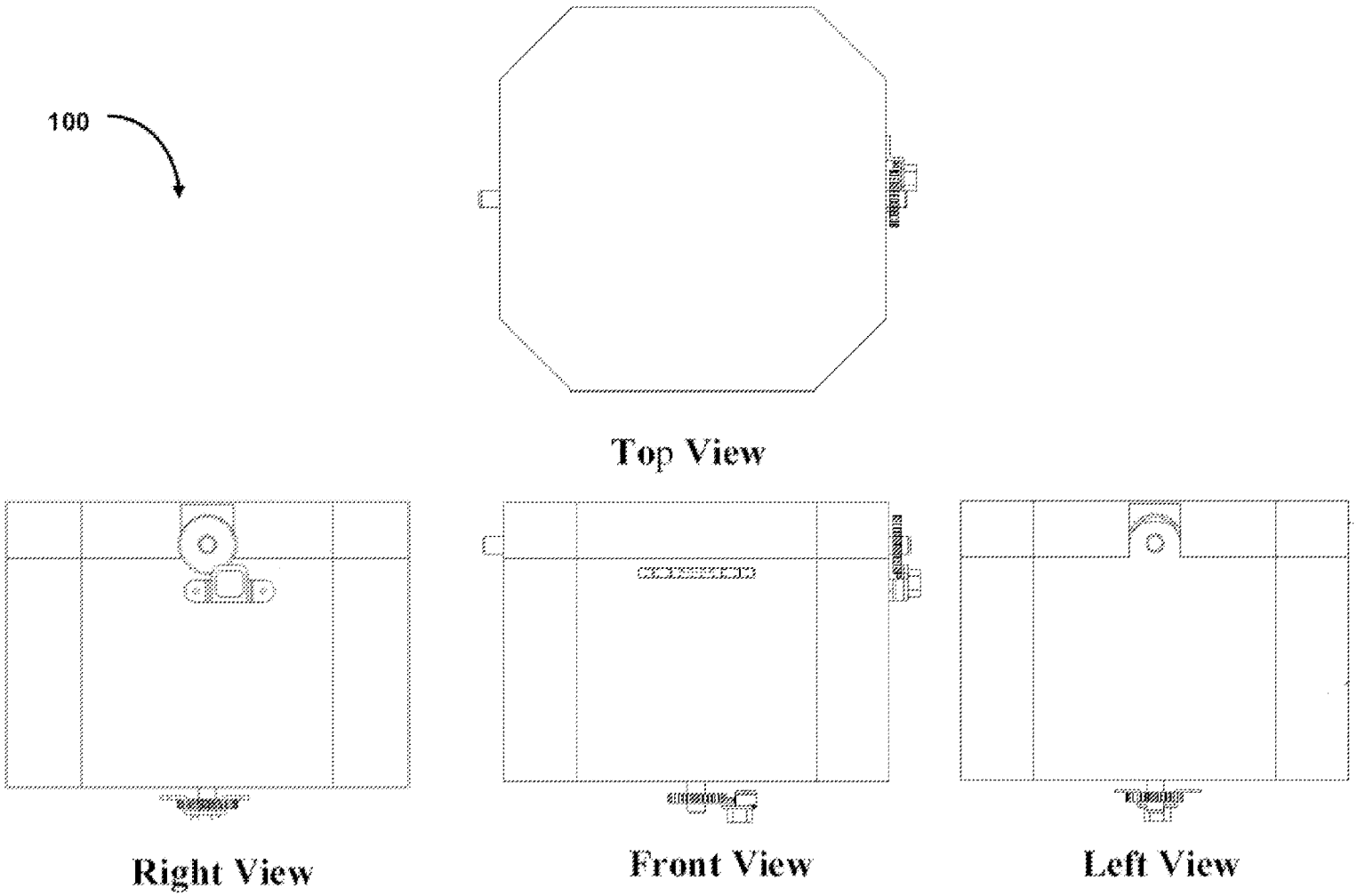
FIG. 2 illustrates top view, right view, front view, side view of the apparatus for storing media, in accordance with an embodiment of the present subject matter.

Referring now to FIG. 1, an apparatus 100 for storing media, in accordance with an embodiment of the present subject matter may be described. Further referring now to FIG. 2, top view, right view, front view, side view of the apparatus 100 for storing media, in accordance with an embodiment of the present subject matter may be described.

Figure 3:
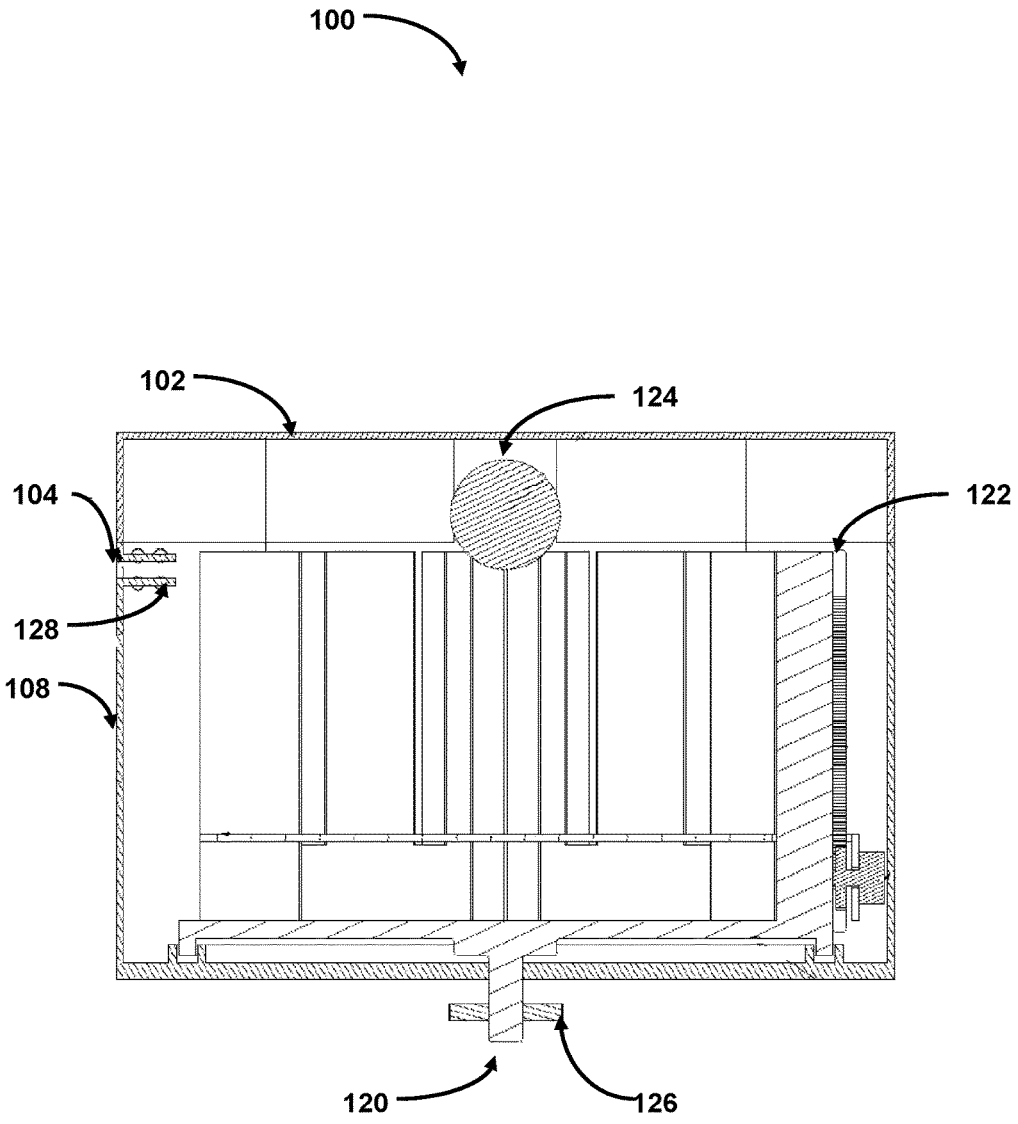
FIG. 3 illustrates sectional view of the apparatus for storing media, in accordance with an embodiment of the present subject matter.
Figure 4:
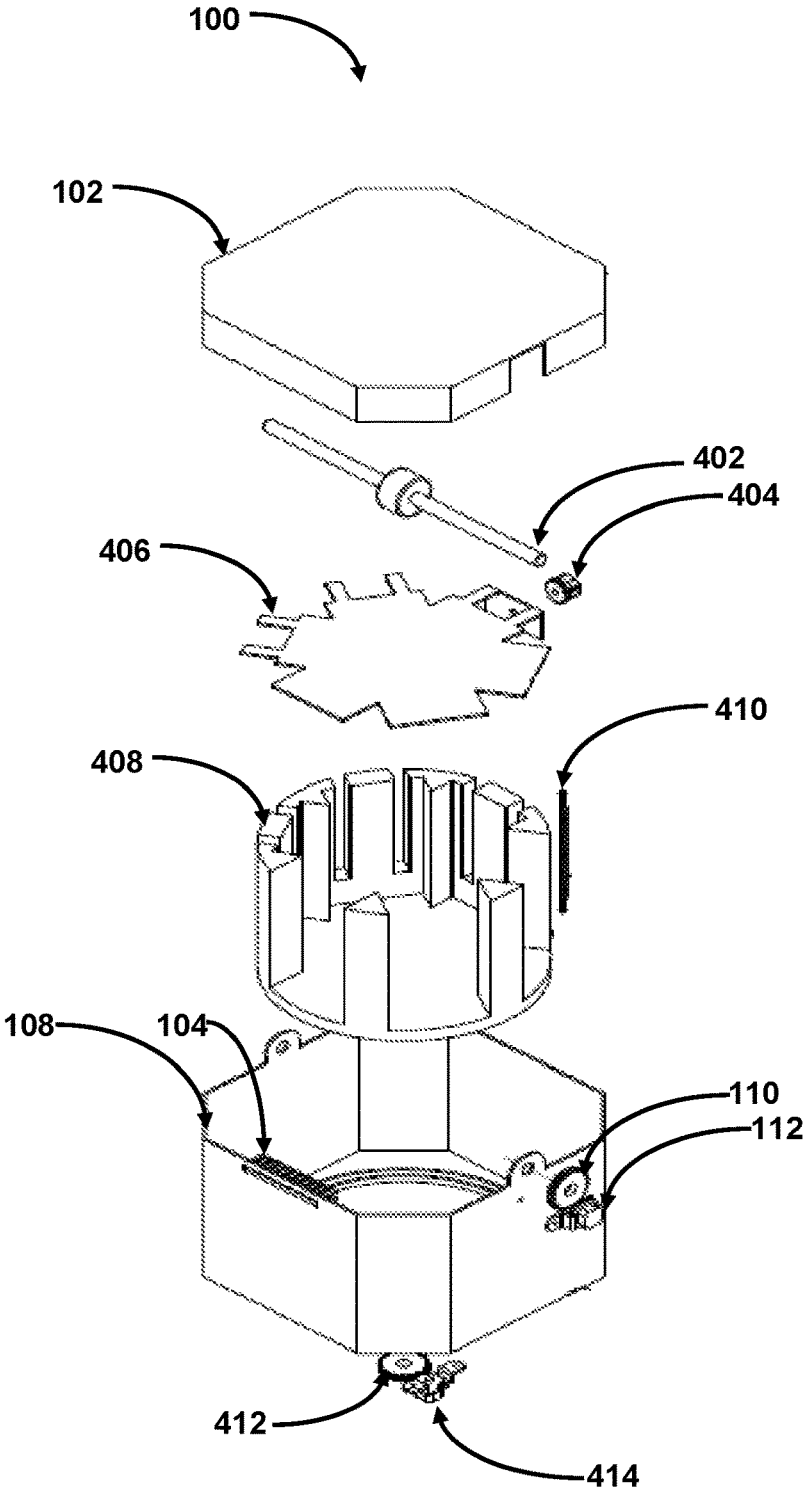
FIG. 4 illustrates exploded view of the apparatus for storing media, in accordance with an embodiment of the present subject matter.
Figure 5:
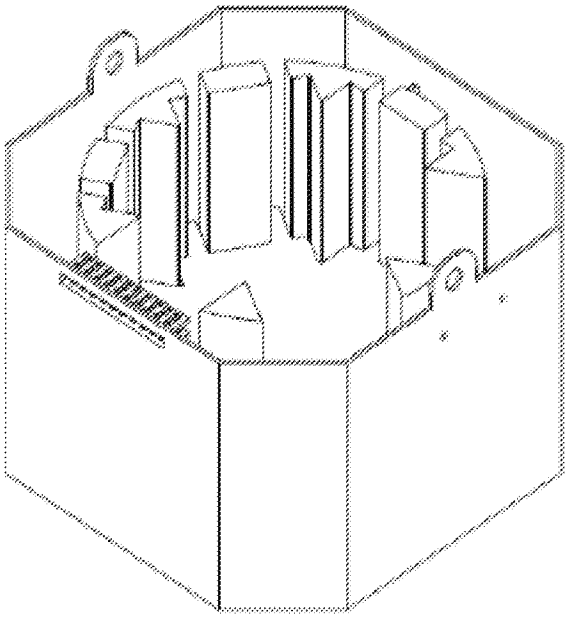
FIG. 5 illustrates the apparatus for storing media, in accordance with an embodiment of the present subject matter.
Figure 5:
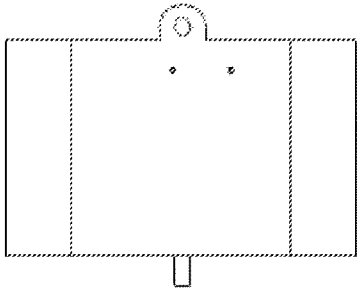
Figure 5:
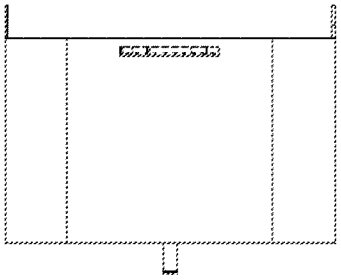
Figure 5:
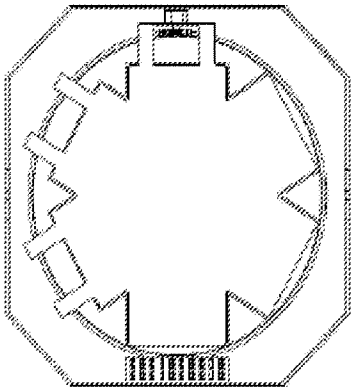
Figure 6:
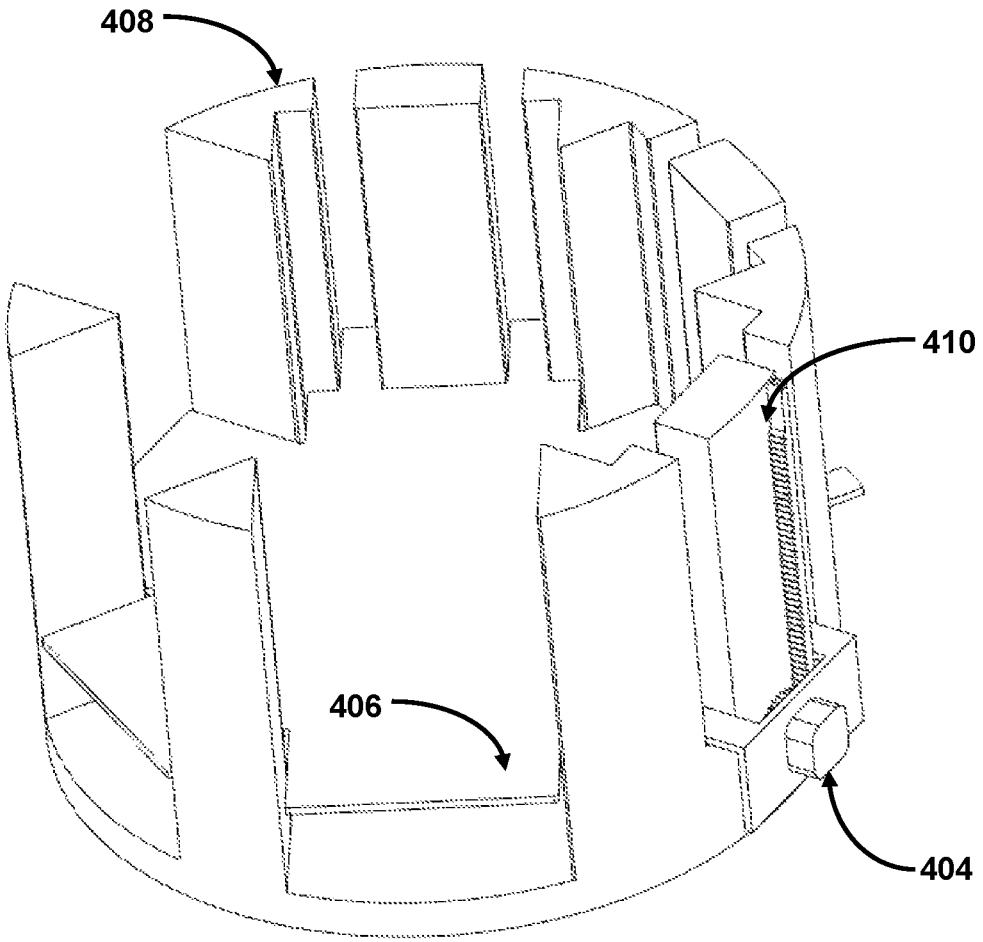
FIG. 6 illustrates the apparatus for storing media, in accordance with an embodiment of the present subject matter.

Referring to FIG. 3 sectional view of the apparatus 100 for storing media may be described, and referring to FIG. 4 exploded view of the apparatus 100 for storing media may be described. Finally, referring to FIG. 5 and FIG. 6 further the apparatus for storing media may be described.

Again referring FIGS. 1-7, in the embodiment, an apparatus 100 for storing media may be disclosed. In one aspect, the apparatus may comprise a bottom cover 108, a pillar assembly 408 mounted inside the bottom cover 108 and a handling plate 406 mounted within the pillar assembly 408 and coupled to the pillar assembly 408 via a linear actuator assembly 122. Further, the bottom cover 108 comprises a cassette indexing mechanism 126 mounted on the bottom surface of the bottom cover 108, a circular slot 702 and a media entry assembly 104 mounted through the side wall of the bottom cover 108. The circular slot 702 may be configured to receive a circular flange on the pillar assembly upon assembly of the apparatus 100. In one example, the linear actuator assembly 122 further comprises linear actuator 404 and linear rack 410. In one more example, the media entry assembly 104 may further comprise one or more idle rollers 128 (as seen in FIG. 3) and aligned to a transport roller assembly 114.

The pillar assembly 408 comprises a shaft 120 extending through the bottom surface of the bottom cover 108 the pillar assembly and a circular flange on the outer side of the bottom surface. The shaft 120 may be coupled with the cassette indexing mechanism 126 for indexing the pillar assembly 408 in a predefined configuration and the circular flange may be configured to assemble with the circular slot on the inner surface of the bottom cover and may act as a guide for the pillar assembly when it rotates. In one example, the predefined configuration may comprise indexing around the central axis of the pillar assembly 408. The cassette indexing mechanism 126 may comprises a gear 412 and a motor 414. Furthermore, the handling plate 406 may be indexed along with the pillar assembly 408 during operation. The linear actuator assembly 122 may be configured to move the handling plate 406 in one of an upward direction and a downward direction. The handling plate 406 may be configured to store a plurality of media indexed with respect to each other.

In the embodiment, the apparatus further comprises a media pick up assembly 124 mounted between the side wall of the bottom cover 108. Further, the media pick up assembly comprises a roller 402, a pressure sensor mounted on the roller (not shown), a gear 110 coupled to one end of the roller and a motor coupled to the gear 112. In one example, the roller may be mounted parallel to the media entry assembly. The apparatus 100 may furthermore comprises a top cover 102 mounted over the bottom cover 108 for completely covering the internal assembly In one more implementation, the apparatus 100 may be configured to receive and store a media, such as bank notes, newspaper, and leaflet the like. In the implementation, the media entry assembly 104 may receive a media. Upon receiving the media, the media may be stored on the holding plate 406. Further, to storing the media, the pillar assembly 408 and in turn the holding plate 406 may be indexed around the central axis by a predefined angle for receiving a next media based on cassette indexing mechanism 126. Thereby a stack of media, where each media is indexed around a central axis at a predefined angle, for example 30 degrees, may be stored within the apparatus 100. Further, as the stack of media increases linear actuator assembly 122 may be configured to move the handling plate 406 in a downward direction.

In one more implementation, the apparatus 100 may be configured to deliver a media from a plurality of media stored within the apparatus 100. In one example, upon receiving the instruction to deliver a media, media pick up assembly 124 may be configured to pick up the media using the roller 402. Upon picking, the media may be provided to the media entry assembly 104 for delivery. Further to delivering, the linear actuator assembly 122 may be configured to move the handling plate 406 in a downward direction. Upon moving in a downward direction, the pillar assembly along with the holding plate may be indexed around the central axis in a pre-defined configuration, such as 30 degrees, so that a new media may be delivered. Subsequent to indexing the linear actuator assembly 122 may be configured to move the handling plate 406 in an upward direction such that the media again makes contact with the roller 402. Thereby the described media delivery cycle may be repeated for delivering a new media. Further, the roller comprises a pressure sensor, for controlling the upward moment of the linear actuator assembly 122 and the total pressure between the roller 402 and the media. In one example, the upward moment of the linear actuator assembly 122 may be limited to the total pressure between the between the roller 402 and the media as detected by the roller 402.

Figure 7:
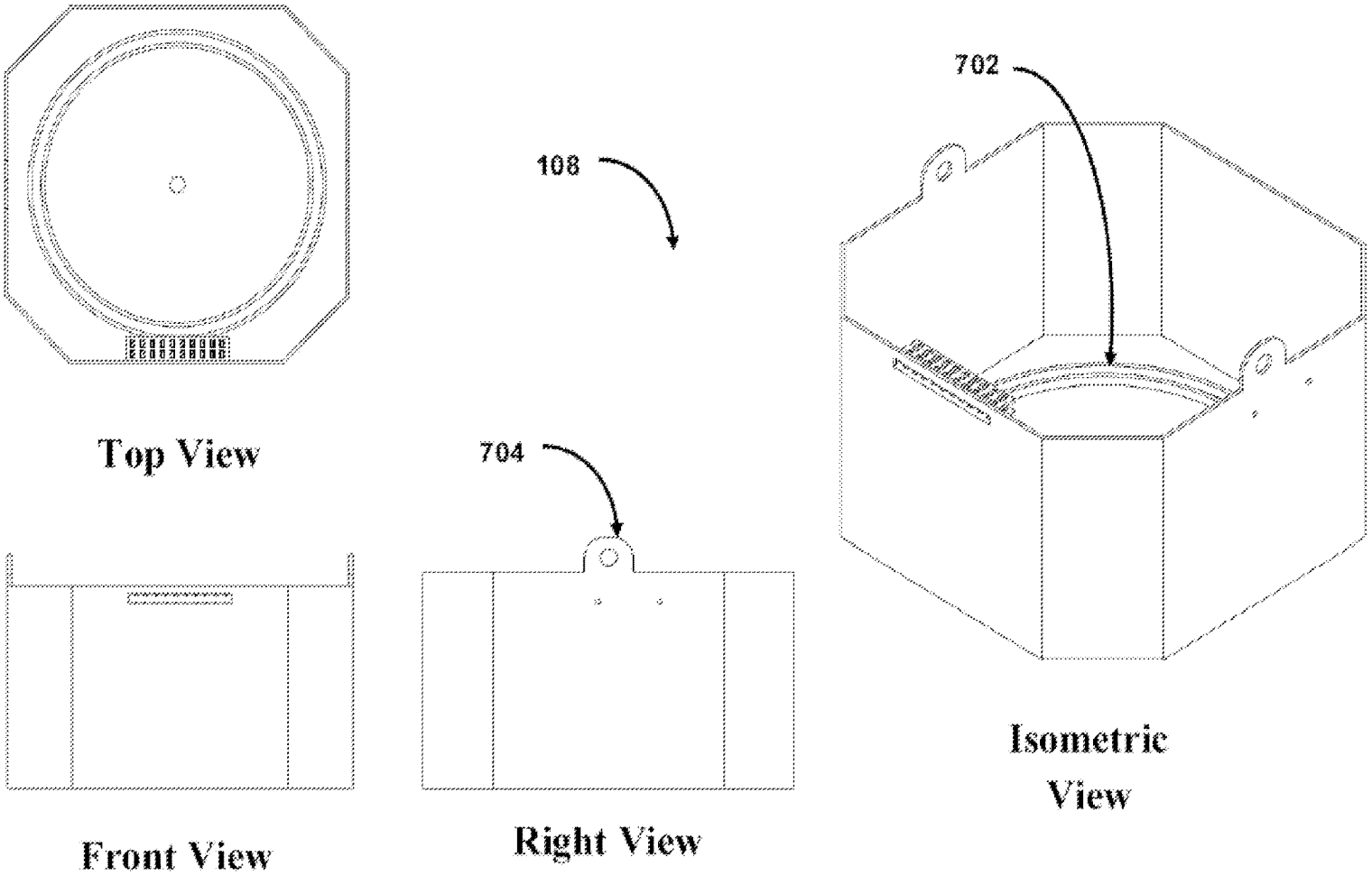
FIG. 7 illustrates a bottom cover of the apparatus for storing media, in accordance with an embodiment of the present subject matter.

Now referring to FIG. 7, the bottom cover 108 of the apparatus for storing media may be described in accordance with an embodiment of the present subject matter. In the embodiment, the bottom cover 108 comprises the cassette indexing mechanism 126 mounted on the bottom surface of the bottom cover 108, a circular slot 702 and a media entry assembly 104 mounted through the side wall of the bottom cover 108. Further, the bottom cover 108 may further comprises a media pick-up support structure 704 for holding the media pick-up assembly 124 upon assembly. Furthermore, the bottom cover 108 comprises a through hole located at the centre of the bottom surface of the bottom cover 108.

Figure 8:
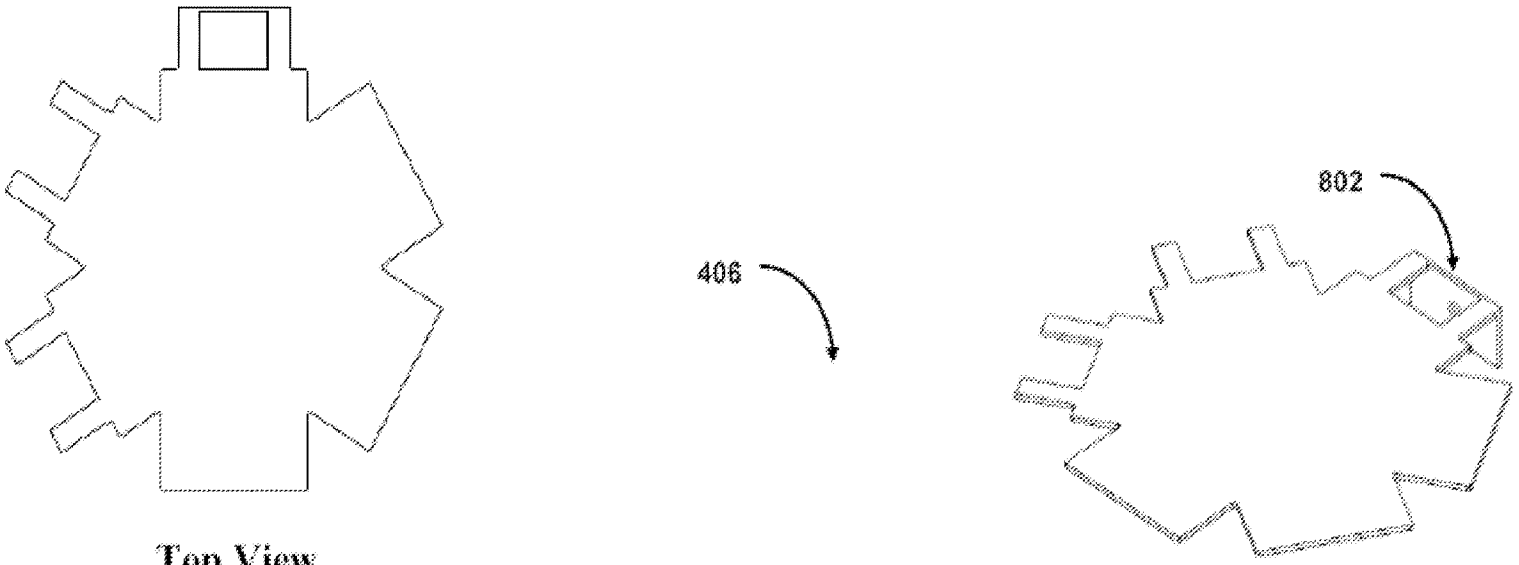
FIG. 8 illustrates a holding plate of the apparatus for storing media, in accordance with an embodiment of the present subject matter.
Figure 8:
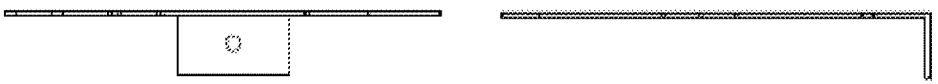

Referring to FIG. 8, a holding plate 406 of the apparatus 100 for storing media may be described in accordance with an embodiment of the present subject matter. In the embodiment the holding plate 406 further comprises an attachment section 802. Further, the attachment section 802 may be configured to couple with the pillar assembly 408 via a linear actuator assembly 122. In one example, the profile of the holding pate 406 may be designed in such a ways the holding plate 406 forms a clearance fit with the pillar assembly 408.

Figure 9:
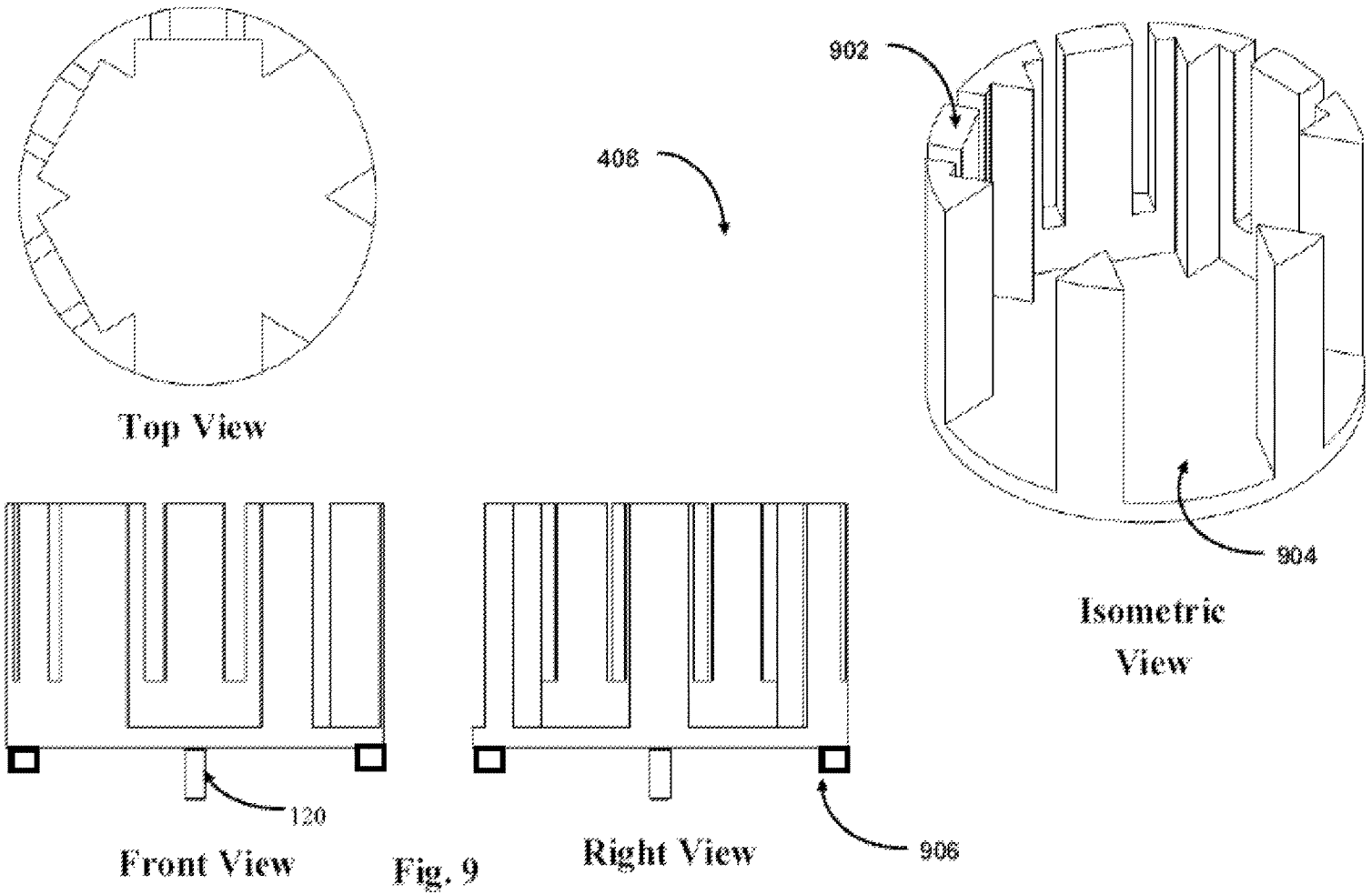
FIG. 9 illustrates a pillar assembly of the apparatus for storing media, in accordance with an embodiment of the present subject matter.

Referring to FIG. 9, a pillar assembly 408 of the apparatus for storing media may be described in accordance with an embodiment of the present subject matter. In the embodiment the pillar assembly 408 further comprises a plurality of pillars 902 arranged along the perimeter of the bottom surface 904 in a predefine configuration. Further, the profile of the plurality of pillars 902 is such that the pillar assembly 408 forms a clearance fit with the holding plate 406. Further the pillar assembly 408 further comprises a shaft 120 located on the bottom surface configured to couple with then indexing mechanism 126, upon assembly.

Figure 10A:
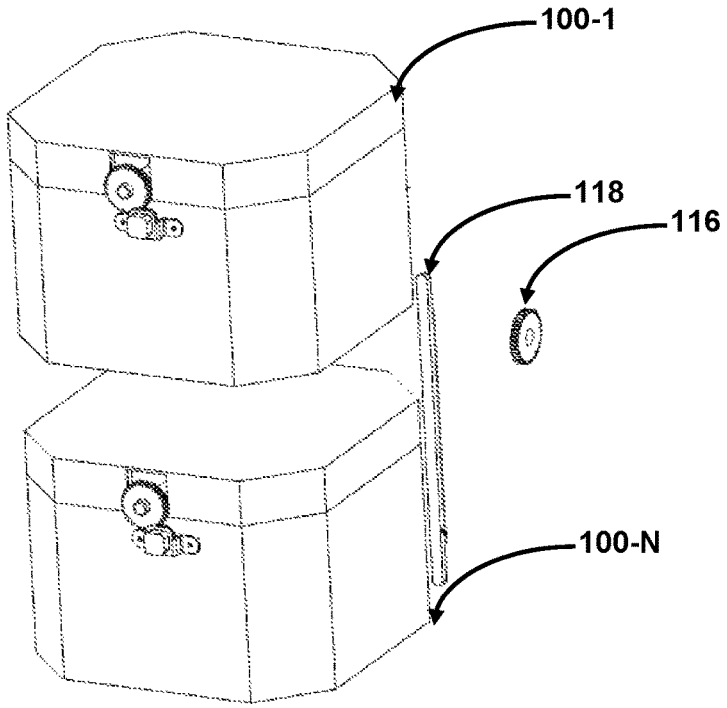
FIGS. 10A and 10B illustrates isometric view of a system comprising plurality of apparatus for storing media, in accordance with an embodiment of the present subject matter.
Figure 10B:
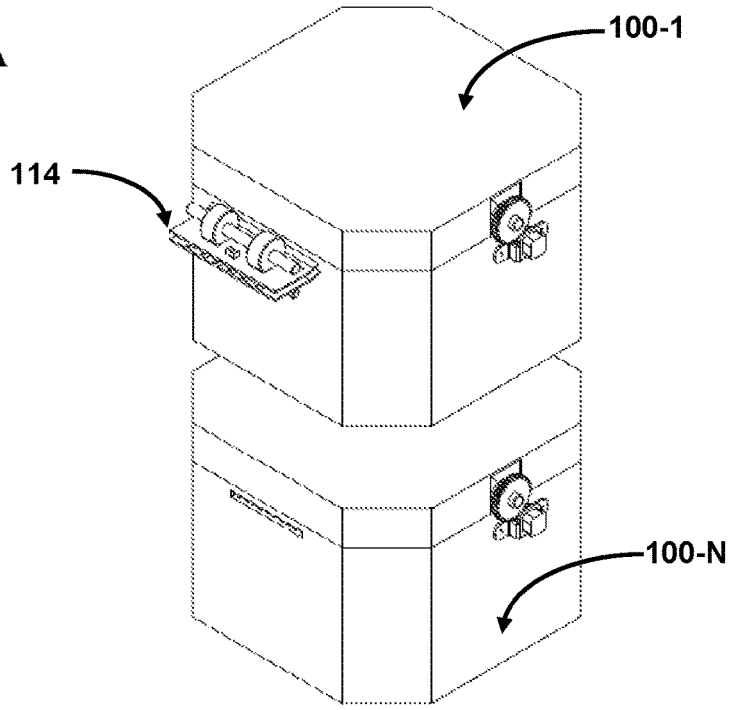
Figure 11:
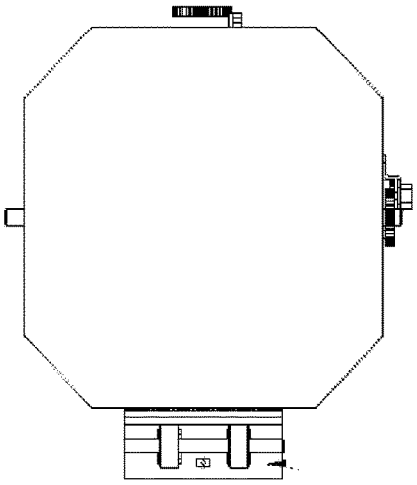
FIG. 11 illustrates top view, front view, and side view of the system comprising a plurality of apparatus for storing media, in accordance with an embodiment of the present subject matter.
Figure 11:
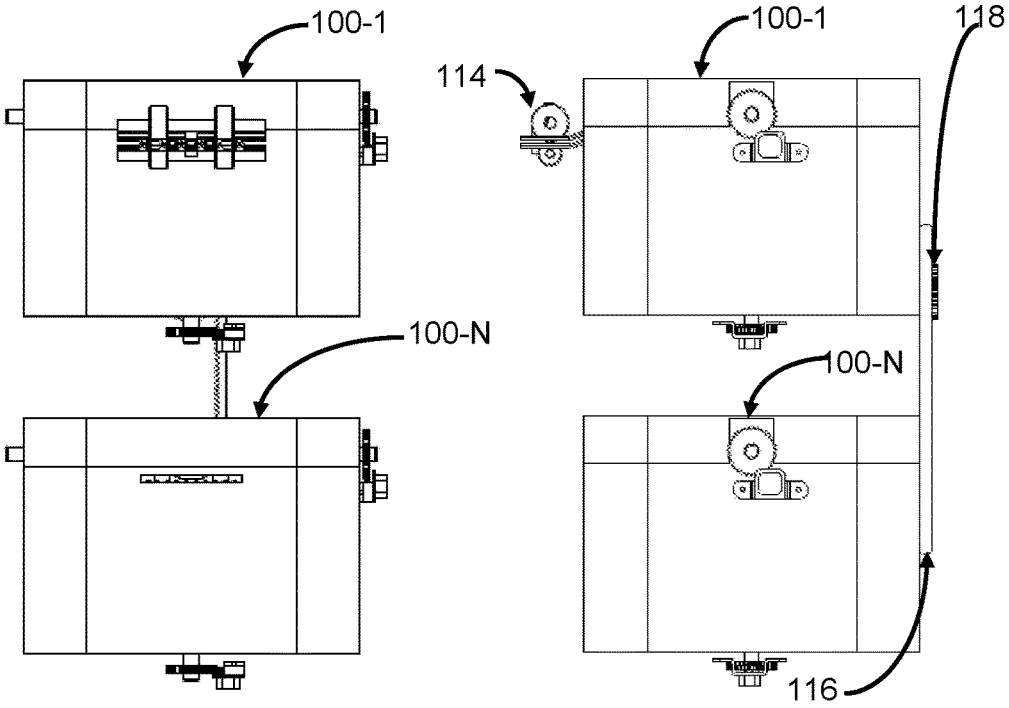

Now referring to FIGS. 10A and 10B isometric view of a plurality of apparatus 100-1 . . . 100-N for storing media coupled to each other is disclosed. Further, FIG. 11 illustrates top view, front view, and side view of the plurality of apparatus 100-1 . . . 100-N for storing media coupled to each other, in accordance with an embodiment of the present subject matter. In example, the plurality of apparatus 100-1 . . . 100-N may be stacked in a vertical format, as shown in FIG. 10A. In one other example, the plurality of apparatus 100-1 . . . 100-N may be stacked in a horizontal format (not shown). In one more example, plurality of apparatus 100-1 . . . 100-N may be stacked in a circular format (not shown). Further, it may be understood that the plurality of apparatus 100-1 . . . 100-N may be stacked in other configurations, such as rectangular and the like. Furthermore, such other configurations would also fall under the purview of the present subject matter.

Referring again to FIGS. 10A and 10B, in the example, the plurality of apparatus 100- . . . 100-N may be coupled to each other via an actuator assembly comprising a rack 118 and a pinion 116 for moment during operation. In one example, during operation, each of the plurality of apparatus 100- . . . 100-N may be configured to receive, store and deliver a unique type of media. For example apparatus 100 may be configured for 100 rupees bank notes whereas 100-N may be configured for a 1000 rupees note. In the example, during operation based on the type of media to be received and store or delivered, for example, 100 rupees or 1000 rupees, the actuator assembly may move the configured apparatus. Upon moving the configured apparatus, the media entry assembly 104 of the apparatus configured with the media type may be aligned with the transport roller assembly, for enabling, receiving or delivering of media from the apparatus 100. Further, any other stacking configurations of the plurality of apparatus 100-1 . . . 100-N may also be enabled based on the above description, thus enabling, receiving or delivering of the media from the apparatus 100.

Exemplary embodiments for storing media discussed above may provide certain advantages. Though not required to practice aspects of the disclosure, these advantages may include those provided by the following features.

Some embodiments of the apparatus enable elimination of multi feed or miss feed.

Some embodiments of the apparatus are cost effective for manufacturing and maintenance.

Some embodiments of the apparatus eliminate complexities.

Some embodiments of the apparatus are easily serviceable.

Although implementations for methods and apparatus for storing media have been described in language specific to structural features and/or methods, it is to be understood that the appended claims are not necessarily limited to the specific features or methods described. Rather, the specific features and methods are disclosed as examples of implementations for storing media.

We claim:

1. A apparatus for storing media, the apparatus comprising:

a bottom cover, wherein the bottom cover comprises a cassette indexing mechanism mounted on the bottom surface of the bottom cover and a media entry assembly mounted through a side wall of the bottom cover;

a pillar assembly mounted inside the bottom cover, where the pillar assembly comprises a shaft extending through the bottom surface of the bottom cover, wherein the shaft is coupled with the cassette indexing mechanism for indexing the pillar assembly in a predefined configuration;

a handling plate mounted within the pillar assembly and coupled to the pillar assembly via a linear actuator assembly, wherein the handling plate is indexed along with the pillar assembly during operation, wherein the linear actuator assembly is configured to move the handling plate in one of an upward direction and a downward direction, and wherein the handling plate is configured to store a plurality of media indexed with respect to each other; and a media pick up assembly mounted on the side wall of the bottom cover wherein the media pick up assembly comprises a roller, a pressure sensor mounted on the roller, a gear coupled to one end of the roller and a motor coupled to the gear, wherein the roller is mounted parallel to the media entry assembly.

2. The apparatus as claimed in claim 1, wherein the media entry assembly is further aligned to a transport roller assembly.

3. The apparatus as claimed in claim 1, further comprising a top cover mounted over the bottom cover.

4. The apparatus as claimed in claim 1, wherein the pillar assembly comprises a circular flange; and the bottom cover comprises a circular slot, wherein during assembly the circular slot is configured to receive the circular flange.

5. The apparatus as claimed in claim 1, wherein the media entry assembly is further aligned to a transport roller assembly.

6. The apparatus as claimed in claim 1, further comprising a top cover mounted over the bottom cover.

7. The apparatus as claimed in claim 1, wherein the pillar assembly comprises a circular flange; and the bottom cover comprises a circular slot, wherein during assembly the circular slot is configured to receive the circular flange.

8. A apparatus for delivering a stored media, the apparatus comprising:

a bottom cover, wherein the bottom cover comprises a cassette indexing mechanism mounted on the bottom surface of the bottom cover and a media entry assembly mounted through a side wall of the bottom cover, wherein during operation a plurality of media may be delivered through the media entry assembly;

a pillar assembly mounted inside the bottom cover, where the pillar assembly comprises a shaft extending through the bottom surface of the bottom cover, wherein the shaft is coupled with the cassette indexing mechanism for indexing the pillar assembly in a predefined configuration during operation; and a handling plate mounted within the pillar assembly and coupled to the pillar assembly via a linear actuator assembly, wherein during operation the handling plate is configured to deliver the plurality of media indexed to each other, wherein the linear actuator assembly is further configured to move the handling plate during operation in at least an upward direction based on a number of media delivered; and a media pick up assembly mounted on the side wall of the bottom cover, wherein the media pick up assembly comprises a roller, a pressure sensor mounted on the roller, a gear coupled to one end of the roller and a motor coupled to the gear, wherein the roller is mounted parallel to the media entry assembly, wherein during operation the media pickup assembly is configured to pick a media from the plurality of media for delivering.

* * * * *